US009896292B2

(12) United States Patent
Kawakita et al.

(10) Patent No.: US 9,896,292 B2
(45) Date of Patent: Feb. 20, 2018

(54) SHEET CONVEYING APPARATUS THAT CONVEYS SHEET, AND IMAGE FORMING APPARATUS

(71) Applicant: CANON KABUSHIKI KAISHA, Tokyo (JP)

(72) Inventors: Akihiro Kawakita, Abiko (JP); Satoru Yamamoto, Noda (JP); Toshiyuki Miyake, Abiko (JP); Katsuya Nakama, Nagareyama (JP); Koji Yumoto, Toride (JP); Riki Fukuhara, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/484,372

(22) Filed: Apr. 11, 2017

(65) Prior Publication Data

US 2017/0297845 A1 Oct. 19, 2017

(30) Foreign Application Priority Data

Apr. 13, 2016 (JP) ..... 2016-080406
Mar. 27, 2017 (JP) ..... 2017-061115

(51) Int. Cl.

| | |
|---|---|
| ***B65H 29/58*** | (2006.01) |
| ***B65H 7/20*** | (2006.01) |
| ***B65H 7/02*** | (2006.01) |
| ***G03G 15/00*** | (2006.01) |

(52) U.S. Cl.

CPC ..... *B65H 7/20* (2013.01); *B65H 7/02* (2013.01); *B65H 29/58* (2013.01); *G03G 15/6529* (2013.01); *B65H 2801/06* (2013.01)

(58) Field of Classification Search

CPC ..... B65H 29/58; B65H 29/60; B65H 7/02; B65H 7/20; B65H 2404/63

See application file for complete search history.

(56) References Cited

U.S. PATENT DOCUMENTS

| | | | | |
|---|---|---|---|---|
| 7,708,276 | B2 * | 5/2010 | Okamoto | B65H 29/58 271/185 |
| 8,167,304 | B2 * | 5/2012 | Fukazawa | B65H 29/58 271/225 |

FOREIGN PATENT DOCUMENTS

| | | | |
|---|---|---|---|
| JP | 2007191232 | A | * 8/2007 |
| JP | 2007276934 | A | * 10/2007 |
| JP | 2010285228 | A | * 12/2010 |
| JP | 2015212717 | A | 11/2015 |

* cited by examiner

*Primary Examiner* — Luis A Gonzalez
(74) *Attorney, Agent, or Firm* — Rossi, Kimms & McDowell LLP

(57) ABSTRACT

A sheet conveying apparatus capable of continuing conveyance of sheets without causing a jam even when a switching member performs an operation for switching a conveyance path again. A switching member is disposed at a branching point of a conveyance path through which the sheet is conveyed by a conveying unit, and is operated by a drive unit for witching a destination of conveyance of the sheet. A controller causes the drive unit to operate the switching member, and performs a checking operation for checking a state of the drive unit based on an output from a sensor that detects a state of the switching member. The controller controls a sheet conveyance interval between a first sheet conveyed by the conveying unit and a second sheet conveyed following the first sheet, according to a result of the checking operation.

13 Claims, 7 Drawing Sheets

SHEET CONVEYING APPARATUS THAT CONVEYS SHEET, AND IMAGE FORMING APPARATUS

BACKGROUND OF THE INVENTION

Field of the Invention

The present invention relates to a sheet conveying apparatus that conveys a sheet to a destination, and an image forming apparatus equipped with the sheet conveying apparatus.

Description of the Related Art

An image forming apparatus includes a sheet conveying apparatus that conveys a recording material (hereinafter referred to as a sheet), and at a branching point of a conveyance path through which the sheet is conveyed by the conveying unit of the sheet conveying apparatus, there is provided a switching member, such as a flapper, for switching a destination to which a sheet is to be conveyed. In the sheet conveying apparatus provided with the flapper, it is required to prevent a sheet from being caught between the flapper and a conveying guide, or from being conveyed to a place other than the destination. To this end, the operation for switching the conveyance path is required to be performed after a trailing end of the preceding sheet has passed the flapper and before a leading end of a sheet following the preceding one reaches the flapper. As a conventional technique concerning the sheet conveying apparatus provided with a flapper, there has been proposed an image forming apparatus in Japanese Laid-Open Patent Publication (Kokai) No. 2015-212717.

However, in the above-mentioned conventional technique, depending on the configuration of the switching member for switching a conveyance path, if paper powder and dust, etc., are attached to component members of the switching member, the current state of the switching member cannot be detected, which sometimes requires a retry operation for performing the operation for switching the conveyance path again. If the switching member cannot attain switching by one switching operation, and the switching operation is to be performed again, the switching operation of the switching member is not finished before a sheet reaches the switching position, causing a jam, depending on the conveyance interval of sheets conveyed.

SUMMARY OF THE INVENTION

The present invention provides a sheet conveying apparatus that is capable of continuing conveyance of sheets without causing a jam even when a switching unit performs an operation for switching a conveyance path again, and an image forming apparatus equipped with the sheet conveying apparatus.

In a first aspect of the present invention, there is provided a sheet conveying apparatus comprising a conveying unit configured to convey a sheet, a switching member disposed at a branching point of a conveyance path through which the sheet is conveyed by the conveying unit, and configured to switch a destination of conveyance of the sheet, a drive unit configured to operate the switching member, a sensor for detecting a state of the switching member, and a controller configured to cause the drive unit to operate the switching member, to perform a checking operation for checking a state of the drive unit based on an output from the sensor, and to control a sheet conveyance interval between a first sheet conveyed by the conveying unit and a second sheet conveyed following the first sheet, according to a result of the checking operation.

In a second aspect of the present invention, there is provided an image forming apparatus comprising a conveying unit configured to convey a sheet, an image forming unit configured to perform image formation on the sheet conveyed by the conveying unit, a switching member disposed at a branching point of a conveyance path through which the sheet is conveyed by the conveying unit, and configured to switch a destination of conveyance of the sheet, a drive unit configured to operate the switching member, a sensor configured to detect a state of the switching member, and a controller configured to cause the drive unit to operate the switching member, to perform a checking operation for checking a state of the drive unit based on an output from the sensor, and to control a sheet conveyance interval between a first sheet conveyed by the conveying unit and a second sheet conveyed following the first sheet, according to a result of the checking operation.

According to the present invention, when switching a conveyance path, if detection of the state of the switching member fails, the sheet conveyance interval is increased by taking into account the time required to detect a state of the switching member again, and hence it is possible to continue conveyance of sheets without stopping the apparatus.

Further features of the present invention will become apparent from the following description of exemplary embodiments (with reference to the attached drawings).

DESCRIPTION OF THE EMBODIMENTS

The present invention will now be described in detail below with reference to the accompanying drawings showing embodiments thereof.

Figure 1:
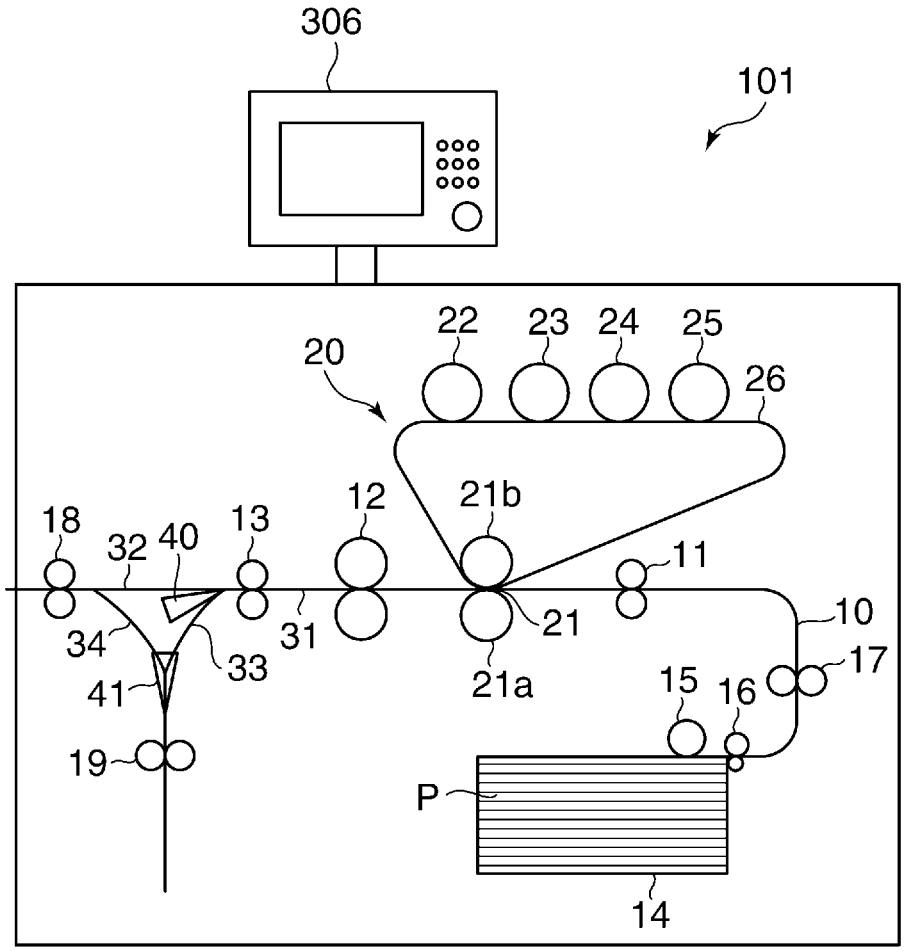
FIG. 1 is a schematic cross-sectional view of an image forming apparatus according to an embodiment.

FIG. 1 is a schematic cross-sectional view of an image forming apparatus according to an embodiment.

Referring to FIG. 1, the image forming apparatus, denoted by reference numeral 101, includes an image forming section 20 comprised of a plurality of image forming stations 22 to 25, and an intermediate transfer belt 26 which is rotated in a state in sliding contact with the image forming stations 22 to 25. A secondary transfer roller 21*a* is disposed in contact with one tension roller 21*b* that stretches the intermediate transfer belt 26, via the intermediate transfer belt 26. Respective contact portions of the intermediate transfer belt 26 and the secondary transfer roller 21*a* form a secondary transfer section 21.

A sheet feeder 14 storing a plurality of sheets P is provided at a lower part of the image forming apparatus 101. The image forming apparatus 101 includes a sheet conveying unit that conveys sheets P contained in the sheet feeder 14 via the secondary transfer section 21 to the outside of the image forming apparatus 101. The sheet conveying unit includes a vertical path 10 connected to the sheet feeder 14, and a horizontal path 31 connected to the vertical path 10.

The horizontal path 31 is branched at an outlet of a fixing section 12 disposed downstream of the secondary transfer section 21 into a straight path 32 and an inversion path 33. At the branching point, there is disposed a flapper 40 as a member for switching a conveyance path. The inversion path 33 is provided with an inversion discharge path 34 for returning a sheet P having front and reverse sides inverted by the inversion path 33 to the straight path 32. At a connection portion between the inversion path 33 and the inversion discharge path 34, there is disposed a flapper 41 as a switching member.

On the vertical path 10, there are disposed a pickup roller 15 for taking in sheets P from the sheet feeder 14, a separation roller 16 for separating the sheets P one by one, and a vertical path roller 17. On the horizontal path 31, there are disposed a registration roller 11, the fixing section 12, and a horizontal path roller 13. Further, on the inversion path 33, there is disposed an inversion path roller 19, and on the straight path 32, there is disposed a discharge roller 18.

The image forming apparatus 101 includes a console section 306 having a display section. The console section 306 receives an instruction from a user, such as an instruction for selecting continuing printing, and further, displays information indicative of an operating state of the apparatus, and so forth, on the display section.

Next, a description will be given of the control configuration of the image forming apparatus 101 shown in FIG. 1.

Figure 2:
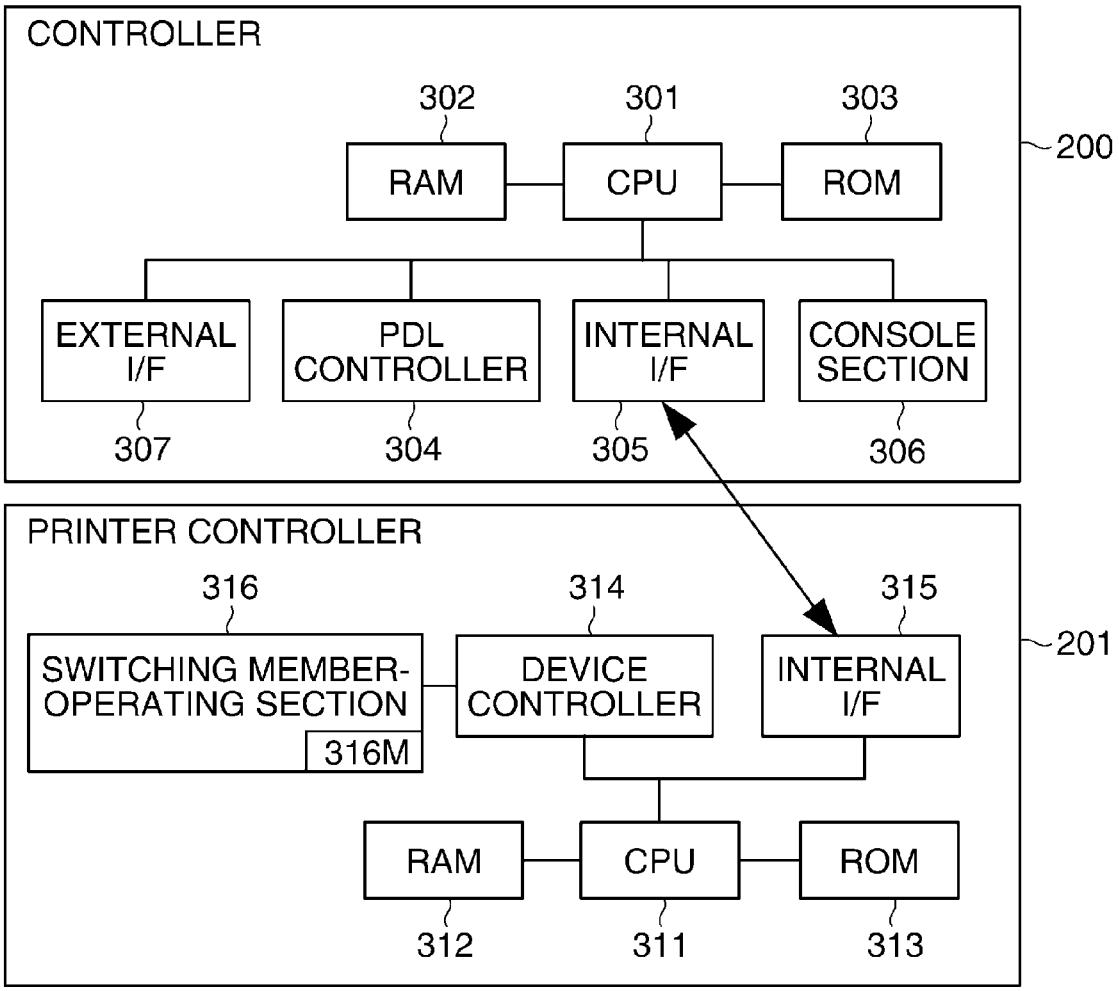
FIG. 2 is a control block diagram of the image forming apparatus shown in FIG. 1.

FIG. 2 is a control block diagram of the image forming apparatus 101 shown in FIG. 1.

Referring to FIG. 2, the control configuration of the image forming apparatus 101 is roughly divided into a controller 200 and a printer controller 201.

The controller 200 includes a CPU 301. The CPU 301 is connected to a RAM 302 and a ROM 303 via an address bus and a data bus. Further, the CPU 301 is connected to an external interface 307, a PDL controller 304, an internal interface 305, and the console section 306. The external interface 307 inputs e.g. a print job from an external device, such as a computer.

The CPU 301 controls the overall operation of the image forming apparatus 101, and manages print jobs. The ROM 303 stores e.g. control programs. The RAM 302 stores e.g. data used for processing. The PDL controller 304 is a processing circuit for manipulating and accumulating print data, and performing image processing on print data. The internal interface 305 is a communication circuit for communicating with the printer controller 201.

The console section 306 includes a display device, such as a liquid crystal display device, and a key input device, such as a touch panel. The CPU 301 receives e.g. an instruction for selecting continuing printing from a user via the key input device. Further, the CPU 301 controls the display section of the console section 306 to display information indicative of the operating state of the apparatus, and so forth.

The printer controller 201 includes a CPU 311. The CPU 311 is connected to a RAM 312 and a ROM 313 via an address bus and a data bus. Further, the CPU 311 is connected to a device controller 314 and an internal interface 315. Further, the CPU 311 is connected to a switching member-operating section 316 via the device controller 314.

The CPU 311 performs basic control of the image forming operation. The ROM 313 stores control programs including a sheet conveying process program for executing a sheet conveying process, described hereinafter. The RAM 312 stores data necessary for image forming processing. The device controller 314 is an electric circuit having input and output ports, etc., for controlling components of the printer section. The internal interface 315 is a communication circuit for transmitting and receiving image signals and timing signals to and from the controller 200.

According to the control programs, the CPU 311 receives image signals from the controller 200, and controls the device controller 314 to thereby cause the same to perform an image forming operation. Further, the CPU 311 controls the switching member-operating section 316 via the device controller 314 to thereby operate the flappers 40 and 41 as the switching members, and so forth. The image forming apparatus 101 may be configured such that the controller 200 and the printer controller 201 are integrated into one unit, and the image forming apparatus 101 is controlled by one CPU in the one unit.

In the image forming apparatus 101 configured as above, the sheets P stored in the sheet feeder 14 are conveyed into the conveyance path by the pickup roller 15 such that after being separated by the separation roller 16 one by one, each sheet P is conveyed into the vertical path 10. The sheet P conveyed into the vertical path 10 is conveyed into the horizontal path 31 by the vertical path roller 17. The sheet P conveyed into the horizontal path 31 is conveyed to the secondary transfer section 21 by the registration roller 11 after being adjusted in timing with the intermediate transfer belt 26.

On the other hand, images of respective colors, such as yellow (Y), magenta (M), cyan (C), and black (Bk), which are formed by the image forming stations 22 to 25 of the image forming section 20 using a known method, are transferred onto the intermediate transfer belt 26 to form a color image thereon. The color image formed on the intermediate transfer belt 26 is conveyed, after being adjusted in timing with the sheet P, to the secondary transfer section 21, where it is transferred onto the sheet P. The sheet P on which the image has been transferred is conveyed into the fixing section 12, wherein pressure and heat are applied to the sheet P, whereby the transferred image is fixed on the sheet P. The sheet P on which the image has been fixed is conveyed by the horizontal path roller 13, and is guided into the inversion path 33 or the straight path 32 by switching of the flapper 40.

The sheet P conveyed into the inversion path 33 is switched back by the inversion path roller 19, and is guided into the inversion discharge path 34 by switching of the flapper 41. The sheet P having passed through the straight path 32 or the inversion discharge path 34 is discharged to the outside of the image forming apparatus 101 by the discharge roller 18.

Next, a description will be given of a sheet conveying process performed by the sheet conveying unit of the image forming apparatus 101 shown in FIG. 1. In the sheet conveying process, it is possible to execute a redetection operation (retry operation) associated with an operation for changing the position of the flapper. Here, the retry operation refers to an operation executed by a sensor (e.g. a sensor 403, referred to hereinafter), after the sensor has failed in state detection for checking the state of a flapper (e.g. the flapper 40) as a switching unit in the conveyance path, to perform the state detection again. The retry operation will be described in detail hereinafter.

Figure 3:
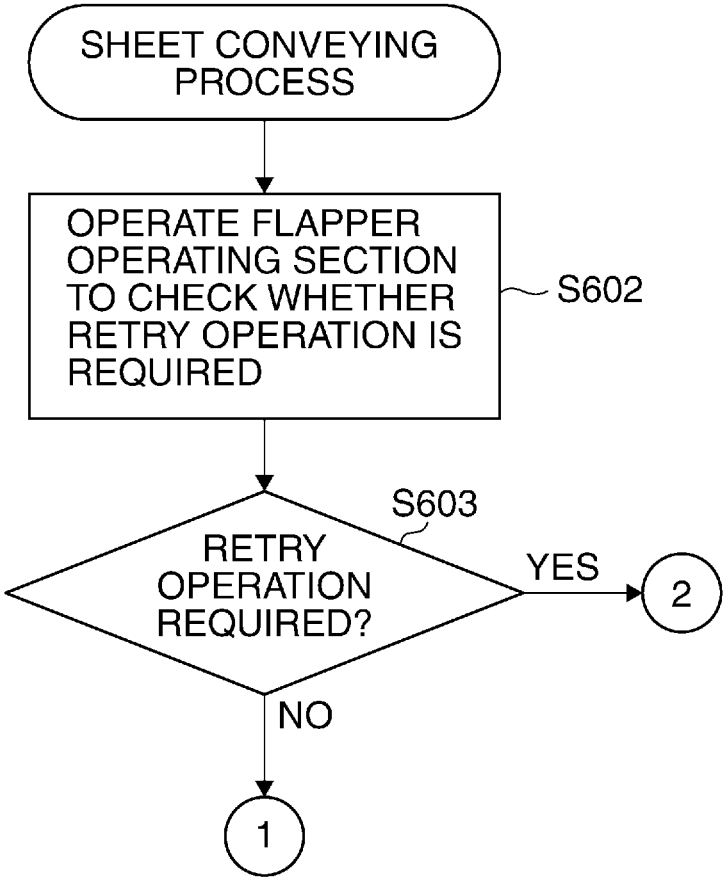
FIG. 3 is a flowchart of a sheet conveying process performed by a sheet conveying unit included in the image forming apparatus shown in FIG. 1.
Figure 4:
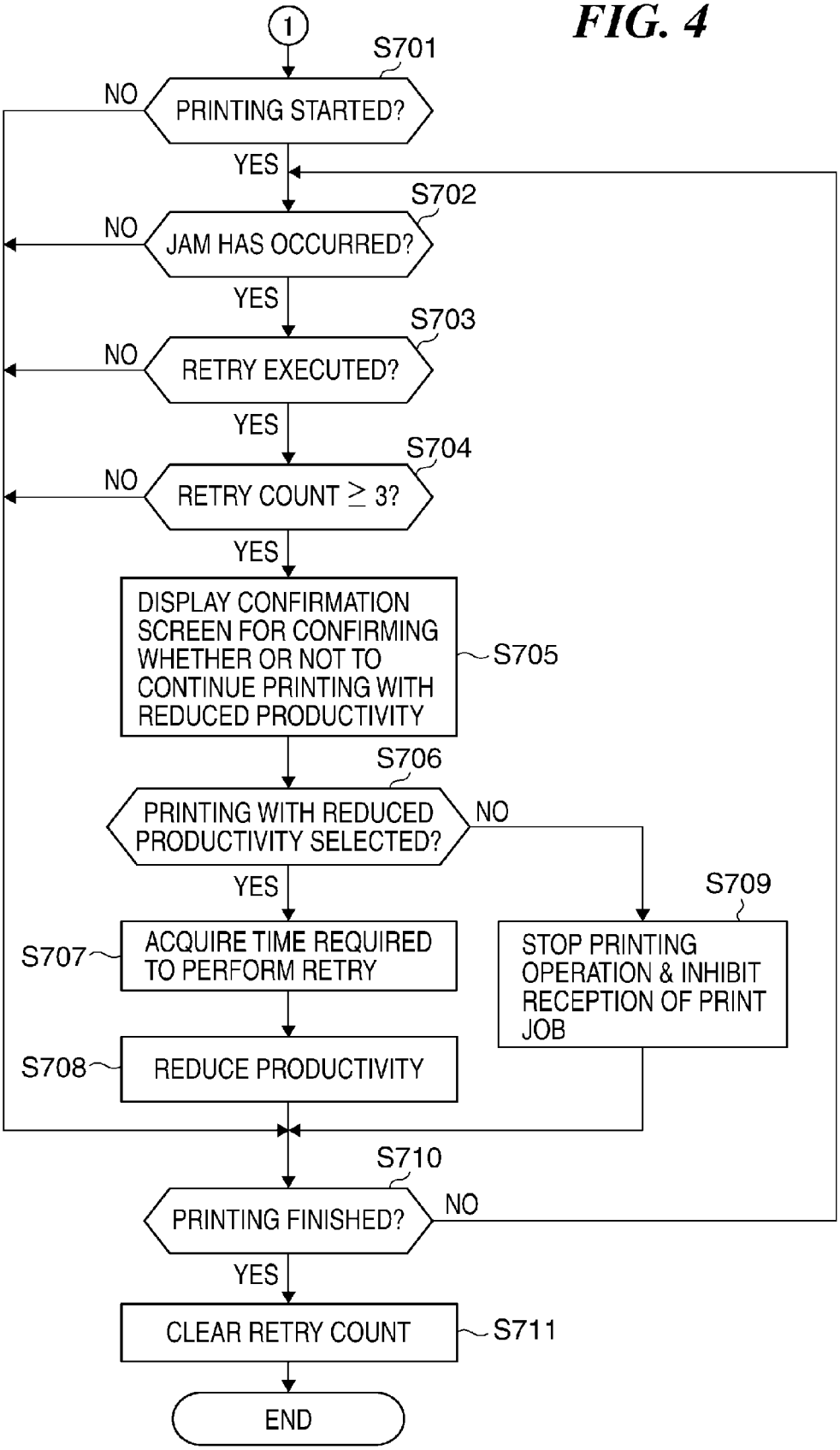
FIG. 4 is a continuation of FIG. 3, performed in a case where it is determined that a retry operation is not required at the activation of the image forming apparatus.
Figure 5:
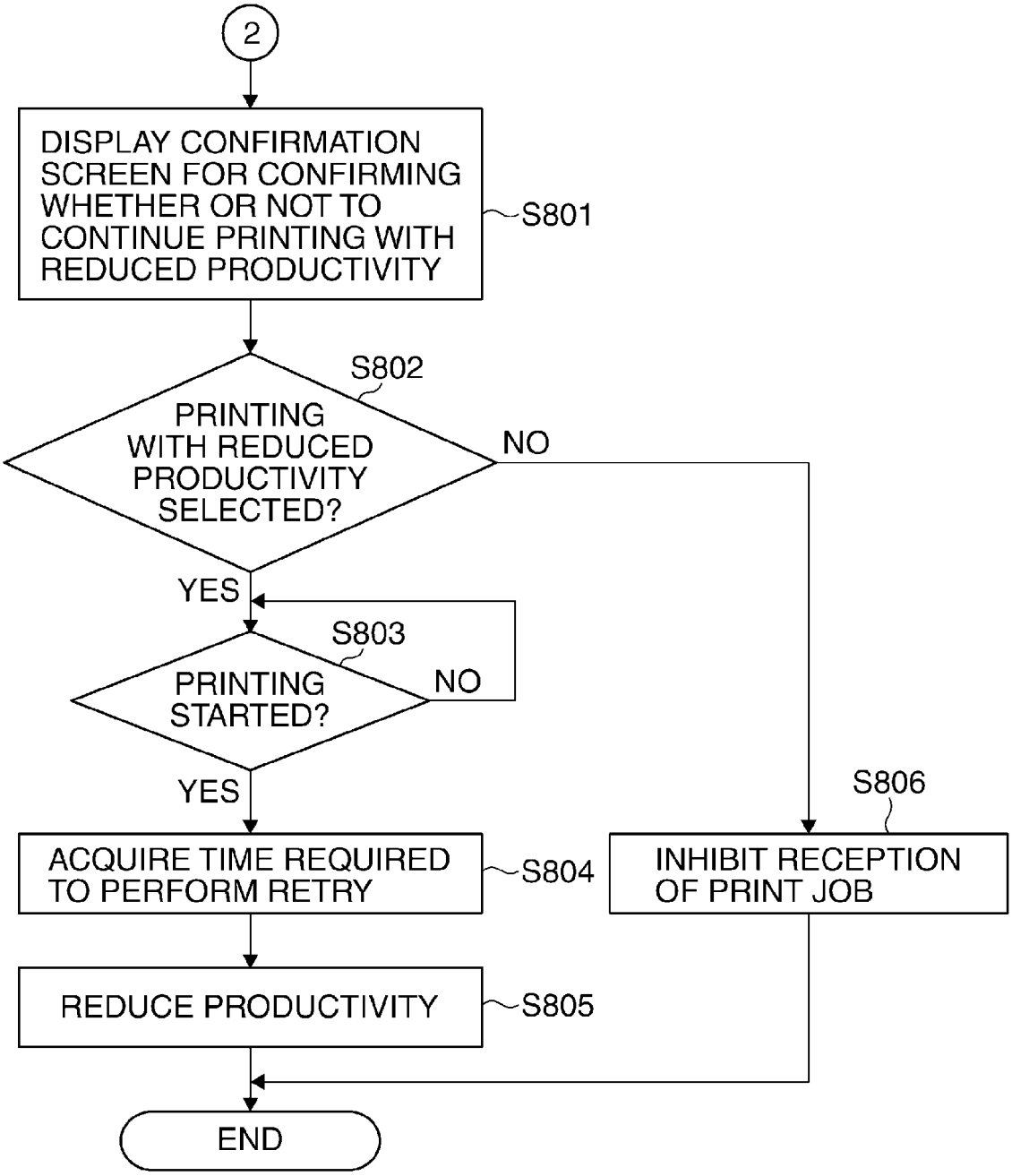
FIG. 5 is a continuation of FIG. 3, performed in a case where it is determined that a retry operation is required at the activation of the image forming apparatus.

FIGS. 3, 4, and 5 are a flowchart of the sheet conveying process performed by the sheet conveying unit included in the image forming apparatus 101 shown in FIG. 1. This sheet conveying process is performed by the CPU 311 of the printer controller 201 of the image forming apparatus 101 according to a sheet conveying process program stored in the ROM 313.

Referring to FIG. 3, first, when the image forming apparatus 101 is activated, the CPU 311 causes the switching member-operating section (hereinafter referred to as the "flapper operating section") 316 to operate, and performs a checking operation for checking the need of the retry operation before actually starting sheet feeding (step S602).

Hereafter, the retry operation performed in the sheet conveying process will be described, while referring to the configuration of the flapper operating section.

Figure 6A:
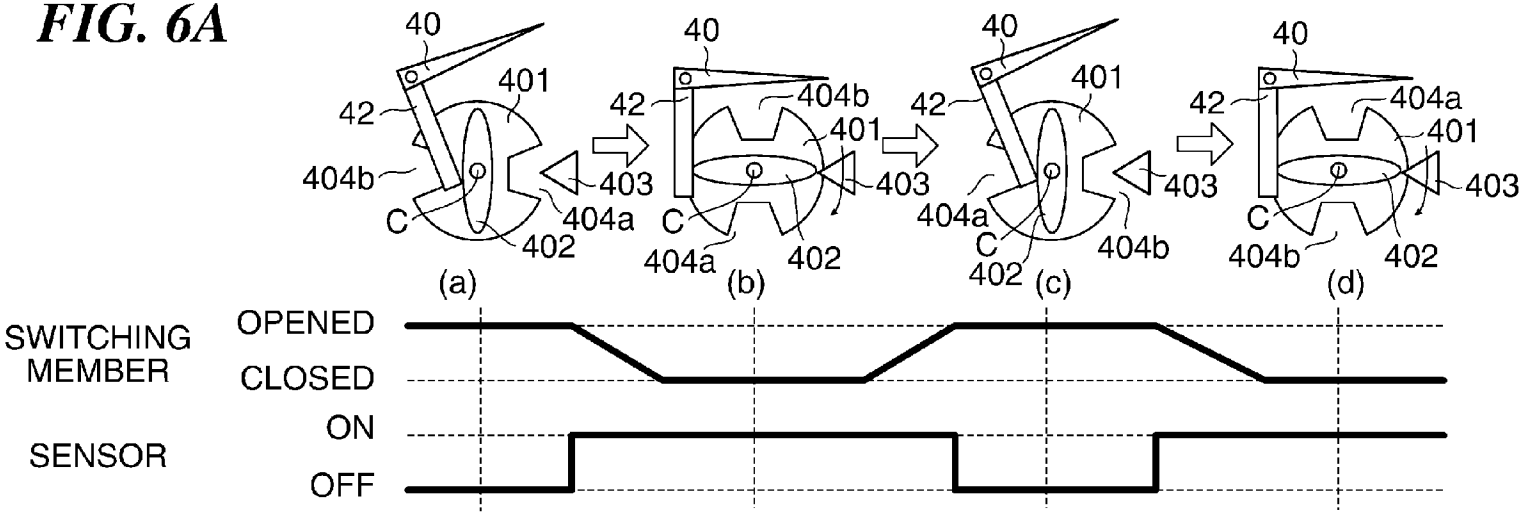
FIGS. 6A and 6B each are a schematic view showing the configuration of a switching member-operating section and operation steps, and a timing diagram of operations.
Figure 6B:
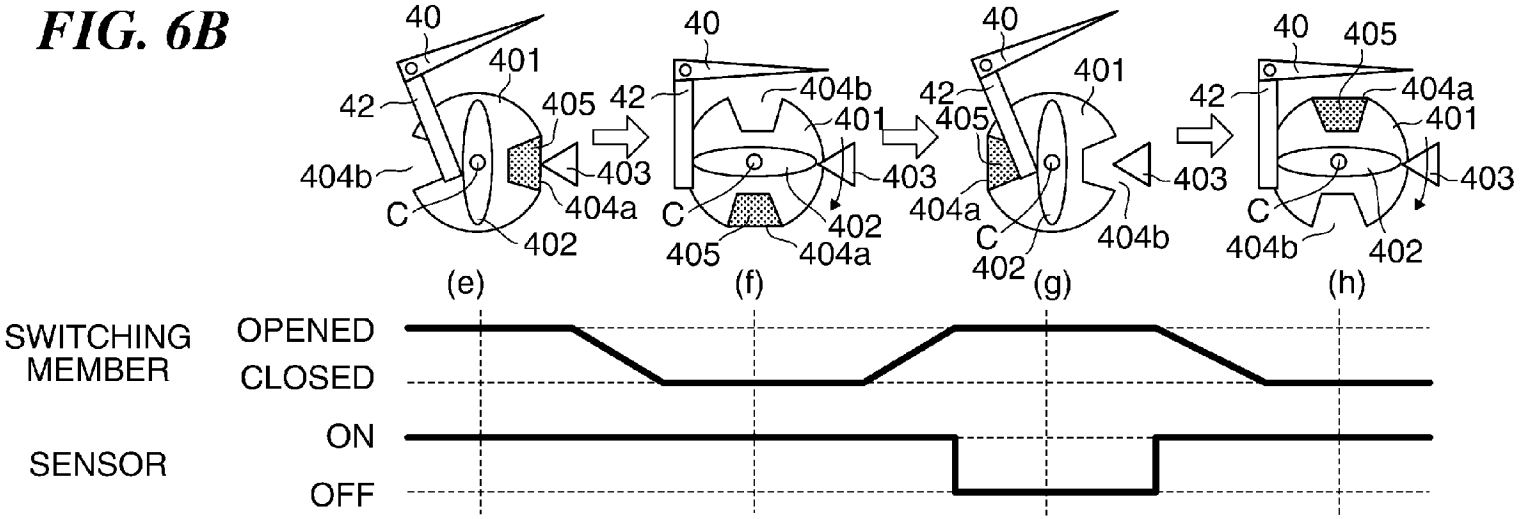

FIGS. 6A and 6B each are a schematic view showing the configuration of the flapper operating section 316 and operation steps, and a timing diagram of operations. Although the following description is given of the flapper 40 as the switching member, the switching operation of the flapper 41 is performed in a similar manner. In this case, it is assumed that the flapper 41 is also provided with a sensor corresponding to the sensor 403, referred to hereinafter.

FIGS. 6A and 6B schematically illustrate the flapper operating section 316. The flapper operating section 316 is comprised of a disc-shaped light shielding flag member 401 as a plate-shaped rotation member for changing the position of the flapper 40 as the switching member, and a stick-shaped cam 402 which is disposed in a predetermined radial direction passing through the center of the light shielding flag member 401. The flapper 40 is engaged with the cam 402 via an arm portion 42, and is repeatedly switched between an urged state in which the flapper 40 is pressed up by the cam 402 which is rotated in accordance with rotation of the light shielding flag member 401 and a released state in which the flapper 40 is released from the pressed state. In the following description, the state in which the flapper 40 is urged by the cam 402 is referred to as the first state, and the released state in which the flapper 40 is released from the urged state is referred to as the second state.

The first or second state of the flapper 40 is detected by the sensor 403. More specifically, an outer peripheral portion of the light shielding flag member 401 is formed with cutouts 404*a* and 404*b* at two locations which are opposed to each other across the center C of rotation of the light shielding flag member 401, and the sensor 403 for detecting the cutouts is disposed at a location opposed to the outer peripheral portion of the light shielding flag member 401. The sensor 403 is implemented e.g. by a photo sensor. The flapper operating section 316 includes a stepping motor 316M for rotating the light shielding flag member 401. Whether the flapper 40 is in the first state or the second state is determined by detection of the cutout 404*a* or 404*b* of the light shielding flag member 401 being rotated by the stepping motor 316M, by the sensor 403.

The flapper 40 is repeatedly switched between the first state in which the flapper 40 is pressed by the cam 402 via the arm portion 42 and the second state in which the flapper 40 is released from the pressed state, whenever the light shielding flag member 401 is rotated through a predetermined angle, such as 90 degrees. That is, in a state in which the sensor 403 detects the cutout 404*a* or 404*b* (one of states (a) and (c) in FIG. 6A), the flapper 40 is in the second state in which the flapper 40 is not urged. If the light shielding flag member 401 is rotated by the stepping motor 316M through 90 degrees in a clockwise direction when the flapper 40 is in the second state, the flapper 40 enters the first state in which it is urged by the cam 402 (states (b) and (d) in FIG. 6A). In short, the position of the flapper 40 is determined by an output from the sensor 403 and an amount of driving of the stepping motor 316M.

Hereafter, a description will be given of the operation processes of the flapper 40 the position of which is changed in accordance with rotation of the light shielding flag member 401.

FIG. 6A shows a normal state in which foreign matter, such as paper powder and dust, is not collected in the cutouts 404*a* and 404*b*.

In the state (a), the cutout 404*a* of the light shielding flag member 401 is in a position opposed to the sensor 403, and the sensor 403 is in an off-state in which the light shielding flag member 401 is not detected. At this time, the flapper 40 is in the first state in which the flapper 40 is urged by the cam 402. When the light shielding flag member 401 is further rotated through 90 degrees in the clockwise direction from the state (a), the state of the flapper operating section 316 is changed to a state (b).

In the state (b), a portion of the light shielding flag member 401 other than the cutout 404*a* or 404*b* is opposed to the sensor 403. Therefore, the sensor 403 is in an on-state in which the light shielding flag member 401 is detected. At this time, the flapper 40 is in the second state in which the flapper 40 is released from the state urged by the cam 402. When the light shielding flag member 401 is further rotated through 90 degrees in the clockwise direction from the state (b), the state of the flapper operating section 316 is changed to a state (c).

In the state (c), the cutout 404*b* of the light shielding flag member 401 is opposed to the sensor 403, and therefore, the sensor 403 is in the off-state in which the light shielding flag member 401 is not detected. At this time, the flapper 40 is in the first state in which the flapper 40 is urged by the cam 402. When the light shielding flag member 401 is further rotated through 90 degrees in the clockwise direction from the state (c), the state of the flapper operating section 316 is changed to a state (d).

In the state (d), a portion of the light shielding flag member 401 other than the cutout 404*a* or 404*b* is opposed to the sensor 403. Therefore, the sensor 403 is in the on-state in which the light shielding flag member 401 is detected. At this time, the flapper 40 is in the second state in which the flapper 40 is released from the state urged by the cam 402. When the light shielding flag member 401 is further rotated through 90 degrees in the clockwise direction from the state (d), the state of the flapper operating section 316 is returned to the state (a).

FIG. 6B shows an abnormal state in which foreign matter 405, such as paper powder and dust, is accumulated in the cutout 404*a* of the light shielding flag member 401.

In a state (e), although the cutout 404*a* of the light shielding flag member 401 is opposed to the sensor 403, since the foreign matter 405 is accumulated in the cutout 404*a*, the sensor 403 is in the on-state, similar to the case where the light shielding flag member 401 is detected. At this time, however, the flapper 40 is in the first state in which the flapper 40 is urged by the cam 402.

In the flapper operating section 316, after the sensor 403 has detected the cutout 404*a* or 404*b*, the light shielding flag member 401 is further rotated through 90 degrees in the clockwise direction, whereby the state of the flapper 40 is changed from the first state to the second state to change the conveyance path. Therefore, as a precondition for switching the conveyance path, the cutout has to be detected by the sensor 403.

However, in the state (e), since the sensor 403 cannot detect the cutout 404*a*, the retry operation for rotating the light shielding flag member 401 to a position of the next cutout 404*b* is performed. Then, when the light shielding flag member 401 is rotated through 90 degrees in the clockwise direction from the state (e), the state of the flapper operating section 316 is changed to a state (f).

In the state (f), a relationship between the sensor 403 and the light shielding flag member 401, and the state of the flapper 40 are the same as those in the above-mentioned state (b). However, the retry operation is being performed due to the fact that the cutout 404*a* could not be detected, and hence the light shielding flag member 401 continues rotation without being stopped, until the state of the flapper operating section 316 is changed to a state (g) in which the light shielding flag member 401 has been further rotated through 90 degrees in the clockwise direction from the state (f).

In the state (g), the cutout 404*b* of the light shielding flag member 401 is opposed to the sensor 403. Therefore, the sensor 403 is in the off-state in which the light shielding flag member 401 is not detected. At this time, the flapper 40 is in the first state in which the flapper 40 is urged by the cam 402. This state is a retry success state in which the cutout 404*b* is detected after performing the retry operation. When the light shielding flag member 401 is further rotated through 90 degrees in the clockwise direction from the state (g), the state of the flapper operating section 316 is changed to a state (h).

In the state (h), the relationship between the sensor 403 and the light shielding flag member 401, and the state of the flapper 40 are the same as those in the above-mentioned state (d). When the light shielding flag member 401 is further rotated through 90 degrees in the clockwise direction from the state (h), the state of the flapper operating section 316 is returned to the state (e).

The operation for determining whether or not the sensor 403 detects the cutout 404*a* or 404*b* by causing the light shielding flag member 401 to rotate, as described above, is referred to as the checking operation. Further, in the case where the cutout 404*a* or 404*b* cannot be detected by the sensor 403 even when the light shielding flag member 401 is rotated through 90 degrees in the clockwise direction, the operation performed for further rotating the light shielding flag member 401 through 90 degrees in the clockwise direction to make an attempt of cutout detection is referred to as the retry operation.

Referring again to FIG. 3, in the step S602, the CPU 311 causes the light shielding flag member 401 to perform one rotation, and checks whether or not the cutout 404*a* or 404*b* is detected by the sensor 403. If both of the cutouts 404*a* and 404*b* are detected by the sensor 403, it is confirmed that the image forming apparatus 101 at the activation thereof is not in a state requiring the retry operation. On the other hand, if only one of the cutouts 404*a* and 404*b* is detected, it is confirmed that the image forming apparatus 101 at the activation thereof is in a state requiring the retry operation.

That is, if both of the cutouts 404*a* and 404*b* are detected by the sensor 403, the retry operation is not required. On the other hand, if only one of the cutouts 404*a* and 404*b* can be detected by the sensor 403, it is considered that paper powder or dust is accumulated in one of the cutouts, and hence it is necessary to perform the retry operation in the sheet conveying process which is to be started after this.

Note that if neither the cutout 404*a* nor 404*b* is detected, it is considered that the foreign matter 405 is accumulated in both of the cutouts 404*a* and 404*b*. Therefore, in this case, it is necessary to stop driving of the apparatus to remove the foreign matter 405.

The CPU 311 determines, based on a result of the checking operation in the step S602, whether or not the retry operation is required (step S603). If it is determined in the step S603 that the retry operation is not required (NO to the step S603), the CPU 311 proceeds to a step S701 et seq. in FIG. 4. On the other hand, if it is determined in the step S603 that the retry operation is required (YES to the step S603), the CPU 311 proceeds to a step S801 et seq. in FIG. 5.

Referring to FIG. 4, the CPU 311 determines whether or not printing has been started by the image forming apparatus 101 (step S701). If printing has been started by the image forming apparatus 101 (YES to the step S701), the CPU 311 proceeds to a step S702. In the step S702, the CPU 311 determines whether or not a jam has occurred at the location of the flapper 40 during conveyance of a sheet P (step S702). Note that after starting printing, if it is required to change the position of the flapper 40 so as to convey a sheet to a designated destination, an operation for changing the position of the flapper 40 is performed. At this time, the sensor 403 performs detection of the cutout 404*a* or 404*b*. In a case where the cutout 404*a* or 404*b* is not detected, the retry operation is performed. If it is determined in the step S702 that a jam has occurred (YES to the step S702), the CPU 311 determines whether or not the retry operation has been performed by the flapper operating section 316 (step S703). If the retry operation has been performed, it is considered that the jam has occurred at the location of the flapper 40 due to the retry operation.

If it is determined in the step S703 that the retry operation has been performed by the flapper operating section 316 (YES to the step S703), the CPU 311 proceeds to a step S704. Note that when the retry operation is performed, the CPU 311 increments the count of the number of times of execution of the retry operation by one. The CPU 311 thus calculates the number of times of execution of the retry operation to determine whether or not the number of times of execution of the retry operation has reached a predetermined number, i.e. three (step S704). If it is determined in the step S704 that the number of times of execution of the retry operation has reached three (YES to the step S704), the CPU 311 proceeds to a step S705. In the step S705, the CPU 311 displays a confirmation screen on the console section 306, so as to prompt the user to confirm whether or not to continue printing with reduced productivity, before resuming image formation after jam release processing (step S705). Note that the productivity corresponds to the number of sheets conveyed per unit time or the number of sheets subjected to image formation, and by increasing the sheet conveyance time interval than normal, the productivity is lowered. In the case where the number of times of execution of the retry operation reaches three, it is considered that the foreign matter 405 is accumulated in the cutout 404*a* or 404*b* of the light shielding flag member 401. Therefore, to prevent a jam from being caused by the same factor during image formation which is to be resumed after releasing the jam, it is effective to reduce the productivity.

Figure 7:
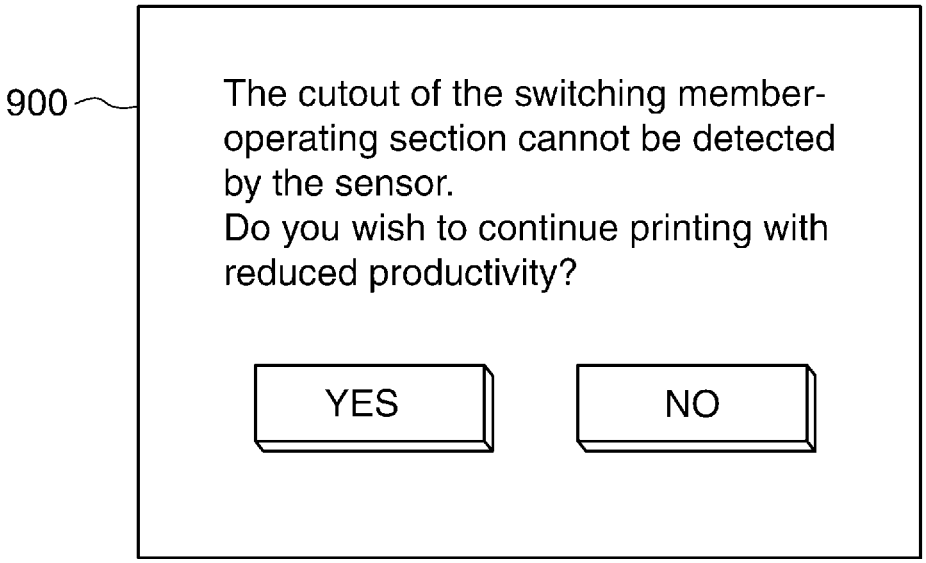
FIG. 7 is a diagram showing a confirmation screen displayed to a user on a display section of a console section.

FIG. 7 is a diagram showing a confirmation screen displayed to a user on the display section of the console section 306. Referring to FIG. 7, the confirmation screen, denoted by reference numeral 900, displays a message "The cutout of the switching member-operating section cannot be detected by the sensor. Do you wish to continue printing with reduced productivity?", and selection buttons of "Yes" and "No". On the confirmation screen 900, the user selects "Yes" or "No".

Referring again to FIG. 4, after the confirmation screen has been displayed for prompting the user to confirm whether or not to continue printing with reduced productivity (step S705), the CPU 311 determines whether or not continuation of printing with reduced productivity is selected by the user (step S706). If it is determined in the step S706 that continuation of printing with reduced productivity is selected by the user (YES to the step S706), the CPU 311 proceeds to a step S707. In the step S707, the CPU 311 acquires a time period required to perform the retry operation, which is stored in the ROM 313 in advance (step S707). In the present embodiment, as a drive motor of the flapper operating section 316, the stepping motor 316M is used, and the time period required to perform the retry operation is determined in the design stage of the image forming apparatus.

After the time period required to perform the retry operation has been acquired (step S707), the CPU 311 causes the device controller 314 to set reduced productivity of printing when resumed, so as to secure the time period required to perform the retry operation (step S708). For example, assuming that the time period required to perform the retry operation is 500 msec, and the sheet conveyance time interval before adjustment of the productivity is 100 msec, it is necessary to secure a sheet conveyance time interval of not shorter than 600 msec. After that, the CPU 311 determines whether or not printing is finished (step S710), and if printing is finished, the CPU 311 clears the count of the number of times of execution of the retry operation in jam occurrence (step S711), followed by terminating the present process. If printing is not finished, the CPU 311 returns to the step S702, and repeats the above-described process.

Here, the sheet conveyance time interval corresponds to a time interval (time difference) between a time at which a preceding sheet being conveyed passes a predetermined reference position, such as the flapper 40, and a time at which the following sheet being conveyed next passes the predetermined reference position. The sheet conveyance time interval varies with the sheet conveyance speed.

On the other hand, if it is determined in the step S706 that continuation of printing with reduced productivity is not selected (NO to the step S706), the CPU 311 proceeds to a step S709. In the step S709, the CPU 311 stops the printing operation, and inhibits reception of a print job thereafter (step S709), followed by terminating the present process.

Further, if it is determined in the step S701 that printing has not been started by the image forming apparatus 101 (NO to the step S701), the CPU 311 proceeds to the step S710. Further, if it is determined in the step S702 that a jam has not occurred (NO to the step S702), the CPU 311 proceeds to the step S710.

Further, if it is determined in the step S703 that the retry operation has not been executed (NO to the step S703), the CPU 311 proceeds to the step S710. Further, if it is determined in the step S704 that the number of times of execution of the retry operation is smaller than three (NO to the step S704), the CPU 311 proceeds to the step S710.

According to the sheet conveying process described with reference to FIG. 4, if it is determined at the activation of the image forming apparatus 10 that the retry operation is not required 1, it is determined whether or not a jam has occurred (step S702), and if a jam has occurred, the confirmation screen is displayed so as to prompt the user to confirm whether or not to continue printing with reduced productivity (step S705). Then, if the user selects continuation (resuming) of printing with reduced productivity, the reduced productivity is set (step S708). As a consequence, even when the retry operation is required after activating the image forming apparatus 101, it is possible to continue sheet conveying processing and image formation processing with the reduced productivity.

If it is determined in the step S603 that the retry operation is required, the CPU 311 proceeds to the step S801 in FIG. 5 to display the confirmation screen, shown in FIG. 7, so as to prompt the user to confirm whether or not to perform printing with reduced productivity, on the display section of the console section 306. Then, the CPU 311 determines whether or not printing with reduced productivity is selected by the user (step S802). If it is determined in the step S802 that printing with reduced productivity is selected by the user (YES to the step S802), the CPU 311 proceeds to a step S803.

The CPU 311 determines whether or not printing has been started by the image forming apparatus 101, and waits until printing is started (step S803). After printing has been started by the image forming apparatus 101 (YES to the step S803), the CPU 311 acquires a time period required to execute the retry operation from the ROM 313 which is a storage section (step S804). Then, the CPU 311 causes the device controller 314 to set reduced productivity so as to secure the time period required to execute the retry operation, which is acquired in the step S804 (step S805), followed by terminating the present process.

On the other hand, if it is determined in the step S802 that printing with reduced productivity is not selected by the user (NO to the step S802), the CPU 311 inhibits reception of a print job thereafter (step S806), followed by terminating the present process.

According to the sheet conveying process described with reference to FIG. 5, if it is determined at the activation of the image forming apparatus 101 that the retry operation is required, first, the confirmation screen is displayed so as to prompt the user to confirm whether or not to perform printing with reduced productivity (step S802). Then, if continuation of printing with reduced productivity is selected by the user (YES to the step S802), the sheet conveyance time interval is increased by the time period required to execute the retry operation to thereby reduce the productivity (step S805). As a consequence, even when the operation for switching the conveyance path is executed again, it is possible to continue conveyance of sheets without causing a jam.

According to the present embodiment, even in a case where the retry operation is performed because the cutout 404*a* or 404*b* of the light shielding flag member 40 is not detected by the sensor 403 when changing the position of the flapper 40 or 41, it is possible to continue the sheet conveying operation and the image forming operation by reducing productivity.

In the present embodiment, it is preferable that the control for increasing a sheet conveyance time interval between a first sheet and a second sheet conveyed following the first sheet, which are conveyed by a conveying unit, by a time period required to execute a retry operation is performed whenever a sheet P passes the flapper 40 or 41. This makes it possible to convey the sheet P to a destination while avoiding occurrence of a jam.

In the present embodiment, to make the sheet conveyance time interval longer than normal, a time interval of feeding sheets from the sheet feeder 14 is made longer than usual (sheet conveyance distance interval between sheets being fed successively is made longer). Instead of changing the sheet conveyance distance interval, the sheet conveyance speed may be lowered. Further, the sheet conveyance distance interval may be increased and the sheet conveyance speed may be lowered. In the case of lowering the sheet conveyance speed, it is also required to reduce the speed of image formation performed by the image forming station. This makes it possible to smoothly perform the image formation processing and processing for transferring a formed image onto a sheet P.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-080406, filed Apr. 13, 2016, and No. 2017-061115, filed Mar. 27, 2017, which are hereby incorporated by reference herein in their entirety.

What is claimed is:

1. A sheet conveying apparatus comprising:

a conveying unit configured to convey a sheet;

a switching member disposed at a branching point of a conveyance path through which the sheet is conveyed by the conveying unit, and configured to switch a destination of conveyance of the sheet;

a drive unit configured to operate the switching member;

a sensor for detecting a state of the switching member; and a controller configured to cause the drive unit to operate the switching member, to perform a checking operation for checking a state of the drive unit based on an output from the sensor, and to control a sheet conveyance interval between a first sheet conveyed by the conveying unit and a second sheet conveyed following the first sheet, according to a result of the checking operation.

2. The sheet conveying apparatus according to claim 1, wherein the controller controls the sheet conveyance interval such that in a case where an abnormality of the drive unit has been detected by execution of the checking operation, the sheet conveyance interval is made longer than in a case where no abnormality of the drive unit has been detected.

3. The sheet conveying apparatus according to claim 2, wherein the drive unit includes a cam member for changing a position of the switching member, and wherein the sensor detects the state of the switching member by detecting a position of the cam member, and wherein the controller controls the sheet conveyance interval such that in a case where the sensor cannot detect the position of the cam member in the checking operation, the sheet conveyance interval is made longer than in a case where the sensor has detected the position of the cam member.

4. The sheet conveying apparatus according to claim 1, wherein the controller executes the checking operation before the conveying unit performs conveyance of the sheet.

5. The sheet conveying apparatus according to claim 4, wherein the controller executes the checking operation when the sheet conveyance apparatus is activated.

6. The sheet conveying apparatus according to claim 1, wherein the controller executes the checking operation, when changing a position of the switching member for selecting the destination of conveyance of the sheet by the conveying unit, after the conveying unit starts conveyance of the sheet.

7. The sheet conveying apparatus according to claim 6, wherein the controller repeats changing the position of the switching member in a case where an abnormality of the drive unit has been detected by the checking operation.

8. The sheet conveying apparatus according to claim 7, wherein in a case where a jam occurs at the branching point, the controller controls the sheet conveyance interval such that in a case where the number of times of changing the position of the switching member has reached a predetermined number, the sheet conveyance interval is made longer than in a case where the number of times of changing the position of the switching member has not reached the predetermined number.

9. The sheet conveying apparatus according to claim 1, further including a display unit for displaying information, and wherein in a case where an abnormality of the drive unit has been detected by execution of the checking operation, the controller causes the display unit to display a screen for prompting a user to select whether or not to reduce productivity of the conveying unit.

10. The sheet conveying apparatus according to claim 3, wherein the cam member is driven for rotation, whereby the position of the switching member is changed to a first state for guiding the sheet to a first destination of conveyance of the sheet when the cam member is in a first position, and is changed to a second state for guiding the sheet to a second destination of conveyance of the sheet when the cam member is in a second position, and wherein the sensor detects whether or not the cam member is in the first position.

11. The sheet conveying apparatus according to claim 10, wherein in a case the position of the switching member is to be changed from the first state to the second state, the controller causes the cam member to rotate through a predetermined angle from a state of the cam member in which the sensor has detected that the cam member is in the first position.

12. The sheet conveying apparatus according to claim 3, wherein the cam member is configured such that during a time period over which the cam member rotates one turn, the position of the switching member is repeatedly changed from the first state to the second state two times.

13. An image forming apparatus comprising:

a conveying unit configured to convey a sheet;

an image forming unit configured to perform image formation on the sheet conveyed by the conveying unit;

a switching member disposed at a branching point of a conveyance path through which the sheet is conveyed by the conveying unit, and configured to switch a destination of conveyance of the sheet;

a drive unit configured to operate the switching member;

a sensor configured to detect a state of the switching member; and a controller configured to cause the drive unit to operate the switching member, to perform a checking operation for checking a state of the drive unit based on an output from the sensor, and to control a sheet conveyance interval between a first sheet conveyed by the conveying unit and a second sheet conveyed following the first sheet, according to a result of the checking operation.

* * * * *